US009156283B2

(12) United States Patent
Boland et al.

(10) Patent No.: US 9,156,283 B2
(45) Date of Patent: Oct. 13, 2015

(54) LIQUID DISPERSAL IN RADIANT DRYERS FOR PRINTING SYSTEMS

(71) Applicants: Stuart J. Boland, Denver, CO (US); Sean K. Fitzsimons, Thornton, CO (US); Scott R. Johnson, Erie, CO (US); William Edward Manchester, Erie, CO (US); Casey E. Walker, Boulder, CO (US)

(72) Inventors: Stuart J. Boland, Denver, CO (US); Sean K. Fitzsimons, Thornton, CO (US); Scott R. Johnson, Erie, CO (US); William Edward Manchester, Erie, CO (US); Casey E. Walker, Boulder, CO (US)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/920,654

(22) Filed: Jun. 18, 2013

(65) Prior Publication Data

US 2014/0366760 A1 Dec. 18, 2014

(51) Int. Cl.
*B41L 35/14* (2006.01)
*B41J 11/00* (2006.01)

(52) U.S. Cl.
CPC ..... *B41J 11/002* (2013.01)

(58) Field of Classification Search
CPC ..... B41J 11/002
USPC ..... 101/488
See application file for complete search history.

(56) References Cited

U.S. PATENT DOCUMENTS

| | | | | |
|---|---|---|---|---|
| 5,214,442 | A | 5/1993 | Roller | |
| 5,845,415 | A * | 12/1998 | Sundqvist | 34/452 |
| 6,223,448 | B1 * | 5/2001 | Motzke et al. | 34/61 |
| 6,427,594 | B1 | 8/2002 | Secor et al. | |
| 6,735,883 | B1 * | 5/2004 | Bria et al. | 34/444 |
| 6,775,925 | B2 * | 8/2004 | Zagar et al. | 34/618 |
| 7,907,873 | B2 | 3/2011 | Sandler et al. | |
| 7,966,743 | B2 | 6/2011 | Piatt et al. | |
| 8,186,820 | B2 * | 5/2012 | Chiwata | 347/100 |
| 8,262,186 | B2 | 9/2012 | Chappell et al. | |
| 8,328,321 | B2 | 12/2012 | Tsuzawa | |
| 2002/0112636 | A1 * | 8/2002 | Desaulniers et al. | 101/487 |
| 2004/0109054 | A1 * | 6/2004 | Martin et al. | 347/102 |
| 2007/0273740 | A1 * | 11/2007 | Tucker et al. | 347/106 |
| 2010/0220163 | A1 * | 9/2010 | Ohkubo | 347/102 |
| 2011/0310417 | A1 | 12/2011 | Takemoto | |
| 2012/0098881 | A1 | 4/2012 | Numata | |
| 2012/0098882 | A1 | 4/2012 | Onishi | |
| 2012/0154498 | A1 | 6/2012 | Chiwata | |
| 2012/0188318 | A1 | 7/2012 | Yamanobe | |
| 2012/0212552 | A1 | 8/2012 | Houjou | |
| 2012/0269226 | A1 * | 10/2012 | Parks et al. | 373/113 |
| 2012/0287195 | A1 | 11/2012 | Boland | |

(Continued)

OTHER PUBLICATIONS

U.S. Appl. No. 13/850,045, "Reduction of Ink Temperatures in a Radiant Dryer," filed Mar. 25, 2013.

(Continued)

*Primary Examiner* — Anthony Nguyen
(74) *Attorney, Agent, or Firm* — Duft Bornsen & Fettig LLP

(57) ABSTRACT

Systems and methods are provided for dispersing a liquid coolant in a radiant dryer. The system comprises a dryer of a printing system. The dryer includes a heating element within an interior of the dryer that is able to heat a web of printed media as the web travels through the interior. The dryer also includes a liquid dispersal unit within the interior that is able to project liquid droplets of coolant onto the web as the web travels through the interior, in order to control the temperature of the web.

20 Claims, 9 Drawing Sheets

(56) References Cited

U.S. PATENT DOCUMENTS

| | | | | |
|---|---|---|---|---|
| 2012/0287196 | A1 | 11/2012 | Boland | |
| 2013/0077999 | A1 * | 3/2013 | Tombs et al. | 399/130 |

OTHER PUBLICATIONS

U.S. Appl. No. 13/781,172, "Dynamic Cooling of Print Media in a Radiant Dryer," filed Feb. 28, 2013.

* cited by examiner

LIQUID DISPERSAL IN RADIANT DRYERS FOR PRINTING SYSTEMS

FIELD OF THE INVENTION

The invention relates to the field of production printing, and in particular, to radiant drying of ink applied to print media.

BACKGROUND

Entities with substantial printing demands typically use a production printer. A production printer is a high-speed printer used for volume printing (e.g., one hundred pages per minute or more). Production printers include continuous-form printers that print on a web of print media stored on a large roll.

A production printer typically includes a localized print controller that controls the overall operation of the printing system, and a print engine (sometimes referred to as an "imaging engine" or a "marking engine"). The print engine includes one or more printhead assemblies, with each assembly including a printhead controller and a printhead (or array of printheads). An individual printhead includes multiple tiny nozzles (e.g., 360 nozzles per printhead depending on resolution) that are operable to discharge ink as controlled by the printhead controller. A printhead array is formed from multiple printheads that are spaced in series across the width of the web of print media.

While the printer is in operation, the web of print media is quickly passed underneath the nozzles, which discharge wet ink at intervals to form pixels on the web. A radiant dryer may be installed downstream from the printer to dry this wet ink. The radiant dryer assists in drying the ink on the web after the web leaves the printer. A typical radiant dryer includes an array of lamps that emit infrared light and heat. The lamps help to dry the ink onto the web as the web passes through the dryer.

Even when a web of print media moves quickly through a dryer, it has a chance of scorching or burning while drying. This is because some portions of the web are darker than other portions of the web, and will absorb more radiant infrared energy from the dryer. For example, a dark marked portion of the web may absorb more energy than un-marked portions or light marked portions of the web. Such an uneven distribution of heat to different portions of the web can also cause permanent warping and distortion of the web.

SUMMARY

Embodiments described herein utilize an in-dryer liquid dispersal unit capable of applying liquid droplets of coolant onto a web of print media. By applying the liquid droplets to cool the web (e.g., by selectively applying droplets of liquid to darker marked portions of the web), the temperature response of the entire web can be made more uniform. This reduces the chances of scorching, burning, warping, and distortion.

One embodiment is an apparatus that comprises a dryer of a printing system. The dryer includes a heating element within an interior of the dryer that is able to heat a web of printed media as the web travels through the interior. The dryer also includes a liquid dispersal unit within the interior that is able to project liquid droplets of coolant onto the web as the web travels through the interior, in order to control the temperature of the web.

Another embodiment is a method. The method comprises operating a heating element within an interior of a dryer to heat a web of printed media as the web travels through the interior. The method also comprises projecting liquid droplets of coolant onto the web as the web travels through the interior of the dryer in order to control the temperature of the web.

Other exemplary embodiments (e.g., methods and computer-readable media relating to the foregoing embodiments) may be described below.

DESCRIPTION OF THE DRAWINGS

Some embodiments of the present invention are now described, by way of example only, and with reference to the accompanying drawings. The same reference number represents the same element or the same type of element on all drawings.

DETAILED DESCRIPTION

The figures and the following description illustrate specific exemplary embodiments of the invention. It will thus be appreciated that those skilled in the art will be able to devise various arrangements that, although not explicitly described or shown herein, embody the principles of the invention and are included within the scope of the invention. Furthermore, any examples described herein are intended to aid in understanding the principles of the invention, and are to be construed as being without limitation to such specifically recited examples and conditions. As a result, the invention is not limited to the specific embodiments or examples described below, but by the claims and their equivalents.

Figure 1:
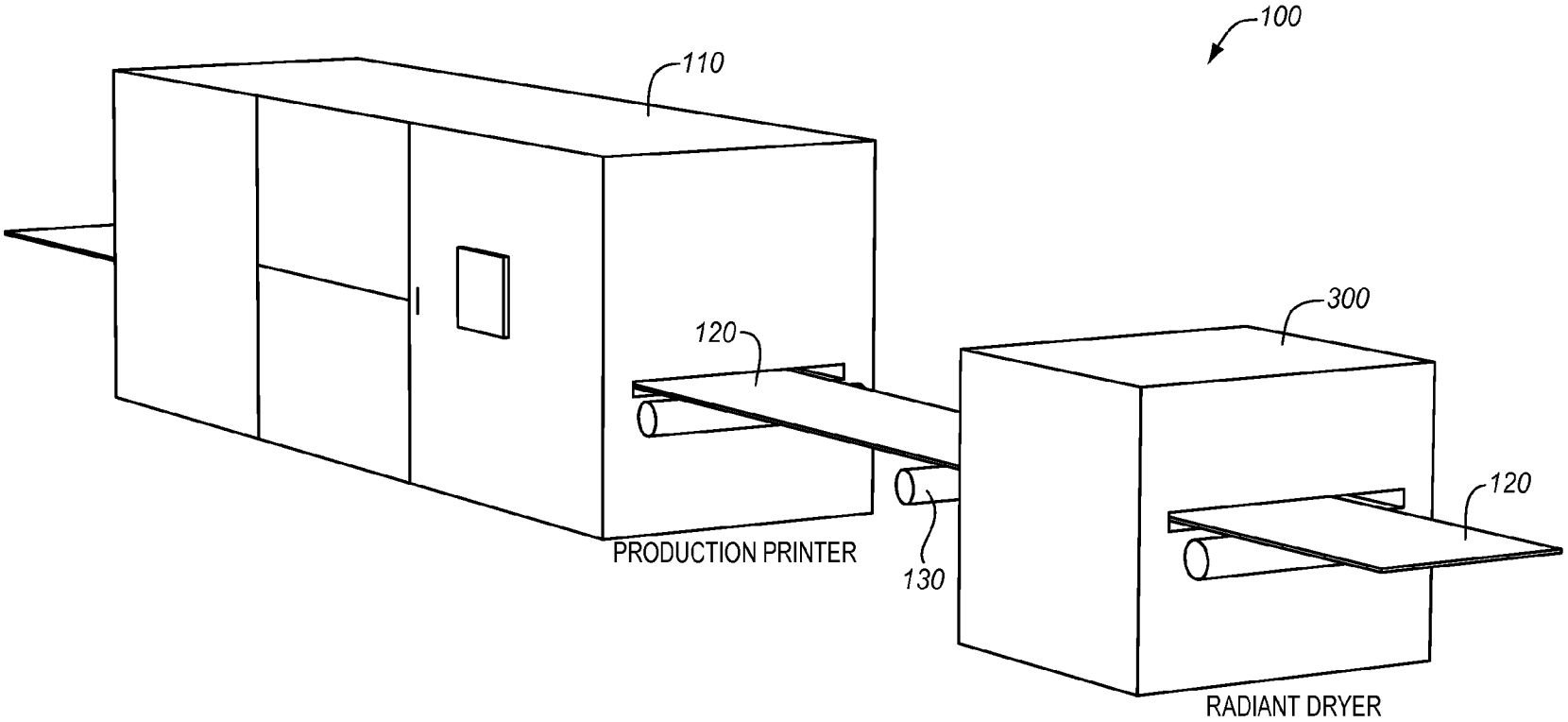
FIG. 1 illustrates an exemplary continuous-forms printing system.

FIG. 1 illustrates an exemplary continuous-forms printing system 100. Printing system 100 includes production printer 110, which is operable to apply ink onto a web 120 of continuous-form print media. As used herein, the word "ink" is used to refer to any suitable marking fluid that can be applied by a printer (e.g., aqueous inks, oil-based paints, etc.). Printer 110 may comprise an inkjet printer that applies colored inks, such as Cyan (C), Magenta (M), Yellow (Y), and Key (K) black inks. The ink applied by printer 110 to web 120 is wet, meaning that the ink may smear if it is not dried before further processing. One or more rollers 130 position web 120 as it travels through printing system 100.

To dry the ink, printing system 100 also includes drying system 300 (e.g., a radiant dryer). Drying system 300 can be installed in printer 110, or can be implemented as an independent device downstream from printer 110 (as shown in FIG. 1). Web 120 travels through drying system 300 where an array of heating elements such as heat lamps (not shown) radiate thermal energy to dry the ink onto web 120.

However, drying ink onto web 120 is not a simple process. Some colors of ink absorb more radiant energy while traveling through a drying system than other colors of ink. For example, "K black" ink and other dark colors are more thermally absorbent than lighter colors. Because the darker colors absorb more radiant energy, they will reach a higher temperature than other colors of ink in drying system 300 and will dry at a faster rate. This means that dark inks may dry completely and overheat to the point that they risk scorching before lighter inks have fully dried.

Figure 2:
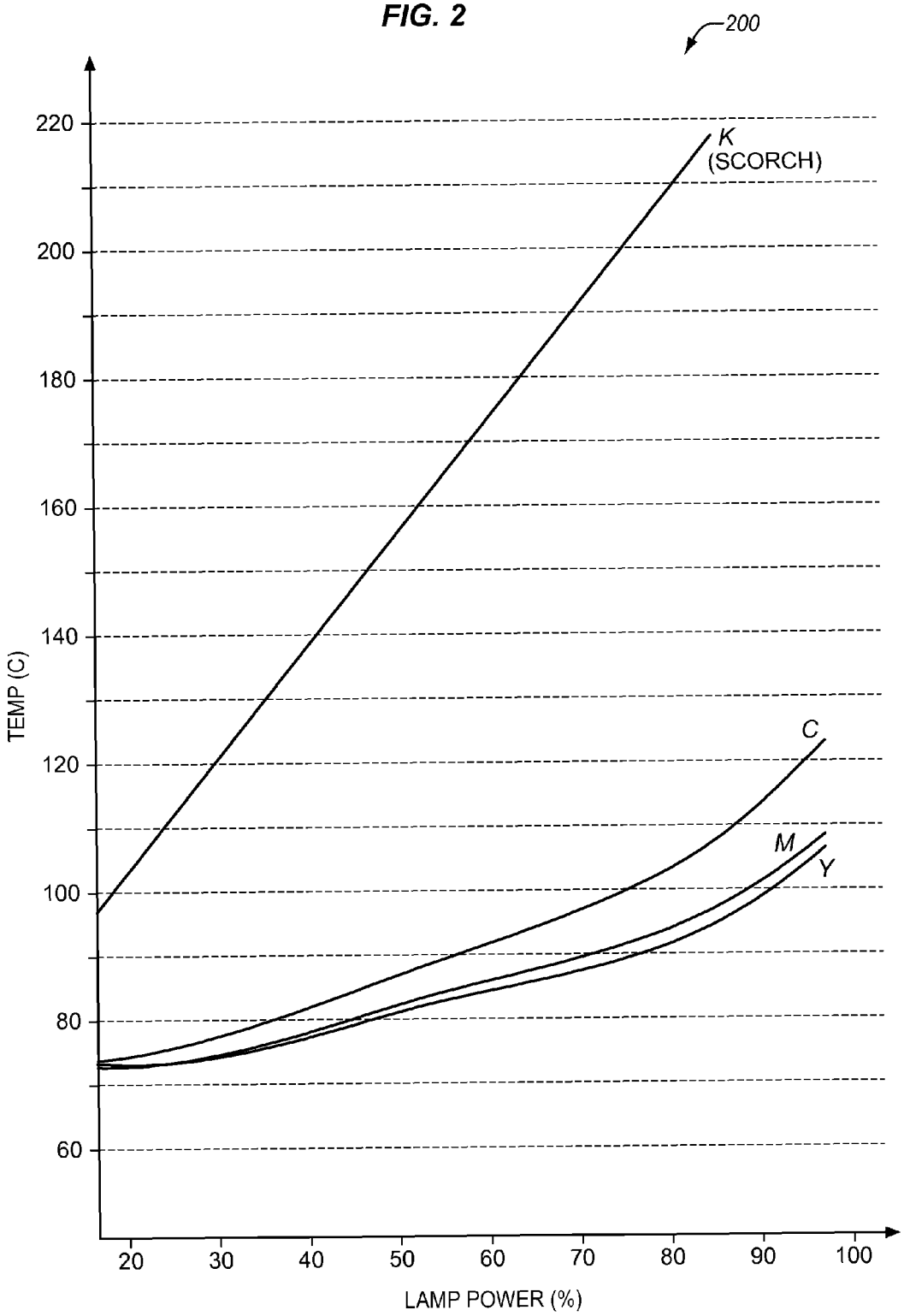
FIG. 2 is a graph illustrating exemplary measured temperatures of inks that have been dried at a drying system.

FIG. 2 is a graph 200 illustrating exemplary measured temperatures of inks that have been dried at a drying system. Specifically, graph 200 illustrates temperatures of C, M, Y, and K black inks as a function of heat lamp power applied to an exemplary drying system. As the heat lamp power increases, the graph shows that the temperatures of C, M, and Y ink also increase at a substantially similar rate. However, K black ink reaches much hotter drying temperatures than the other ink colors. Thus, as the lamp power increases, the temperature of K black ink becomes much higher than the temperature of other colors. For example, at 90% lamp power, the temperature of K black ink is about 220° C., while for the other colors, the temperature is roughly 105° C. and the inks may therefore not be fully dry.

When dark ink reaches a high temperature within a drying system (e.g., about 220° C.), there is a risk that web 120 will scorch, burn, shrink, tear, or become discolored. To prevent these problems, drying system 300 has been enhanced with a liquid dispersal unit. The liquid dispersal unit applies liquid droplets to web 120 while web 120 is within drying system 300. The liquid droplets may be applied uniformly, or may be applied selectively to different regions of web 120. In either case, the liquid reduces the overall temperature of web 120, and the liquid can also be used to prevent dark regions on web 120 from overheating. Specifically, the energy absorbed by the dark regions is transferred to the liquid. The liquid undergoes a phase change to gas as it absorbs the energy. The energy that drives the phase change for the liquid is therefore not available to increase the temperature of the dark regions, which means that the dark regions do not experience such a large increase in temperature while traveling through drying system 300. This prevents scorching, burning, and other associated issues associated with overheating at web 120.

Figure 3:
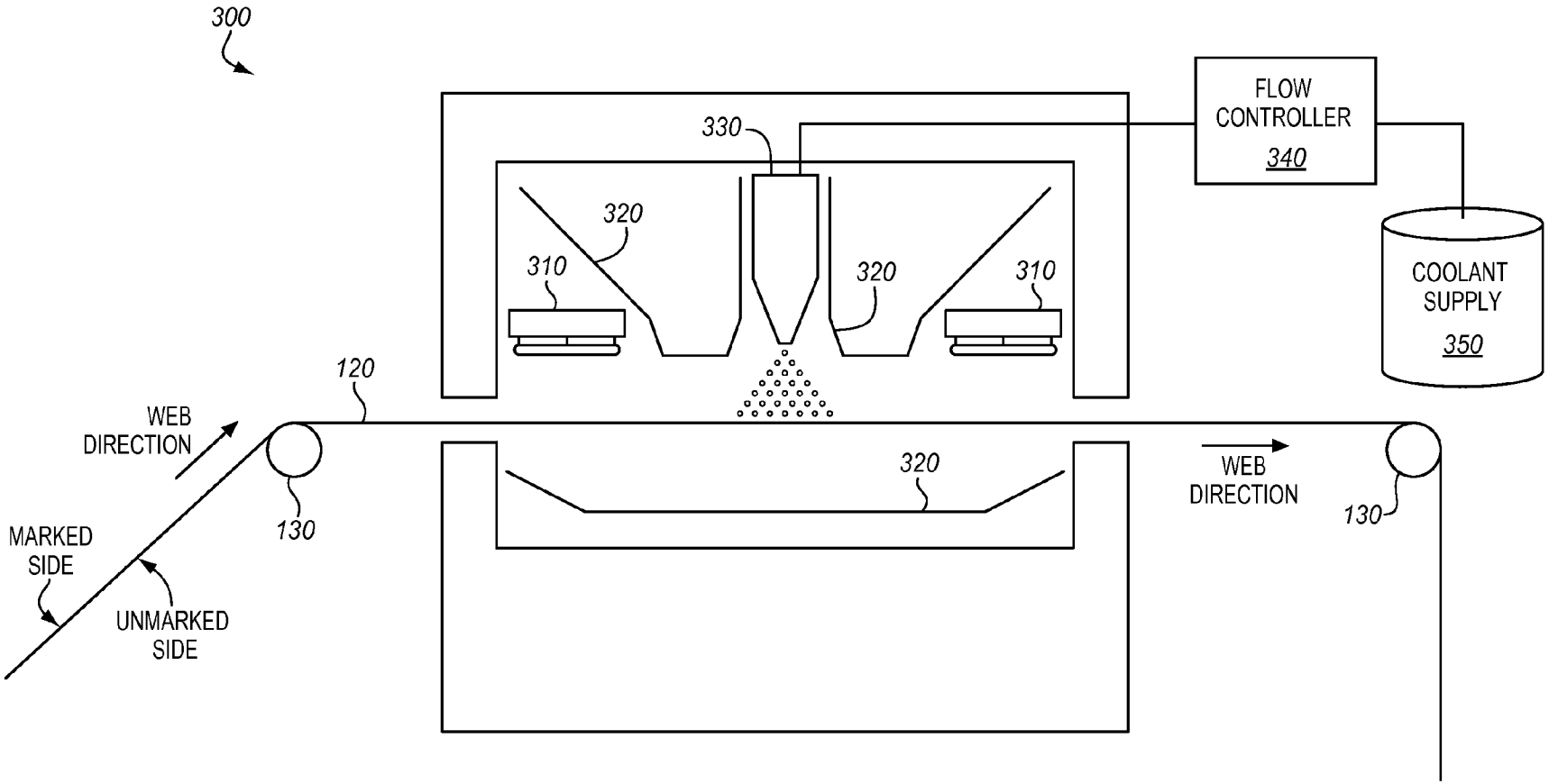
FIG. 3 is a diagram of a drying system in an exemplary embodiment.

FIG. 3 is a diagram of a drying system 300 in an exemplary embodiment. Drying system 300 receives web of printed media 120, which has been marked by an upstream printer and tensioned by rollers 130. Drying system 300 operates one or more heating elements 310 to dry ink onto web 120. Radiant energy from heating elements 310 is reflected by thermal reflectors 320, which reduce waste heat and also keeps internal components of drying system 300 from overheating.

Drying system 300 has been enhanced to include liquid dispersal unit 330. Liquid dispersal unit 330 projects droplets of liquid coolant (e.g., water) onto web 120 as it travels through drying system 300. The droplets of liquid coolant absorb energy from heating elements 310 until they undergo a phase change to gas. The absorbed energy drives the phase change of the liquid to gas, instead of increasing the temperature of web 120. Thus, particularly in embodiments where the liquid is selectively applied to dark regions, light colored inks can be heated and fully dried without the dark regions overheating. Therefore, drying system 300 reduces the chances that marked portions of web 120 that are highly absorptive (e.g., marked in black or dark colors) will scorch or burn due to the radiant energy applied by heating elements 310.

Liquid dispersal unit 330 may comprise a nozzle, a diffuser or other fluid flow device capable of receiving liquid and applying droplets of the liquid onto web 120. Liquid dispersal unit 330 may further comprise an array of nozzles along the width of web 120. In one embodiment, liquid dispersal unit 330 comprises an insulated printhead array that applies liquid water to web 120.

Coolant supply 350 serves as a reservoir of liquid coolant that can be provided to liquid dispersal unit 330, and may comprise a cooled, compressed, or pressurized container for supplying the liquid. Flow controller 340 manages the rate at which liquid is supplied to web 120 by liquid dispersal unit 330. For example, in one embodiment, flow controller 340 may comprise a manual valve used to apply a uniform layer of liquid droplets to web 120. In some embodiments, flow controller 340 comprises an electronically implemented controller (e.g., a circuit, or a processor implementing programmed instructions) that actively controls the rate at which coolant is applied to web 120. Flow controller 340 may further control the amount of fluid applied to different regions along web 120, so that dark (or high temperature) regions receive a larger volume of liquid than light (or low temperature) regions.

While specific elements are described with regard to printing system 100 of the above figure, the arrangement and type of elements used in these figures may vary as desired in order to dry webs of print media. For example, different numbers, arrangements, and types of each component may be used as desired.

Illustrative details of the operation of drying system 300 will be discussed with regard to FIG. 4. Assume, for this embodiment, that printer 110 has marked web 120, and that web 120 is being received at drying system 300 for processing.

Figure 4:
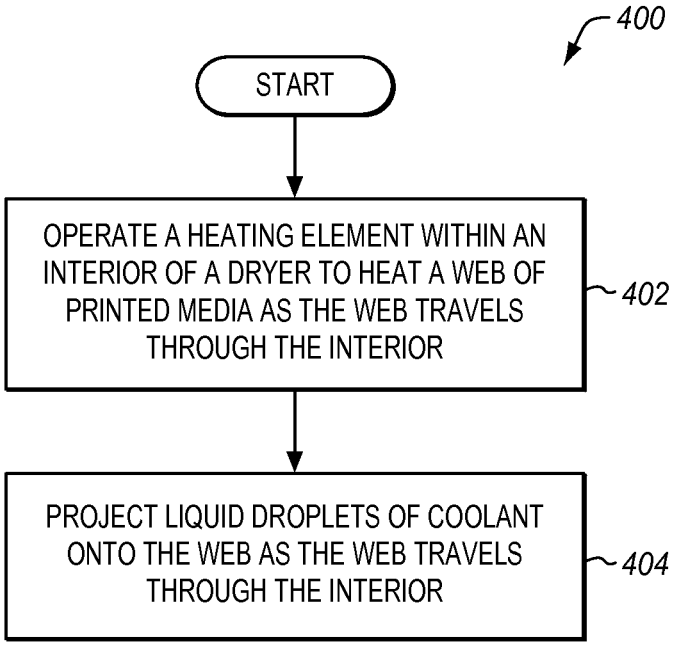
FIG. 4 is a flowchart illustrating a method for operating a drying system in an exemplary embodiment.

FIG. 4 is a flowchart illustrating a method 400 for operating a drying system in an exemplary embodiment. The steps of method 400 are described with reference to drying system 300 of FIG. 3, but those skilled in the art will appreciate that method 400 may be performed in other systems. The steps of the flowcharts described herein are not all inclusive and may include other steps not shown. The steps described herein may also be performed in an alternative order.

In step 402, heating elements 310 are operated to heat web 120 as web 120 travels across the interior of drying system 300. In one embodiment, heating elements 310 are heat lamps that are electrically powered to radiate thermal energy to heat web 120.

In many drying systems, the radiant energy applied by heating elements 310 is the primary source of energy that dries web 120. However, because some marked portions of print media absorb radiant energy differently than other marked portions, web 120 can quickly experience large differences in temperature between different regions (e.g., between light inked regions and dark inked regions).

To address this problem, liquid dispersal unit 330 projects droplets of liquid coolant onto web 120 within the interior of drying system 300 in step 404. This is not merely projecting a humid gas onto web 120. By projecting physical droplets of coolant that are in a liquid phase, liquid dispersal unit 330 ensures that the coolant will be physically placed onto web 120. This ensures that the coolant will remain on web 120 and undergo a phase change to gas as heat is applied to web 120. The phase change contributes to convective cooling processes for web 120, which in turn balance out (to some degree) the amount of heat absorbed at web 120 from heating elements 310. In one embodiment, liquid dispersal unit 330 may selectively apply liquid droplets along the width and length of web 120 as desired (e.g., based on where dark or high temperature regions are located at web 120). However, even when the droplets of liquid are applied uniformly across web 120, the liquid may cool web 120 and also facilitate heat transfer between light and dark regions, thereby reducing the differences in temperature between them.

Method 400 intentionally inserts a liquid coolant into the heated interior of a dryer. By performing this counter-intuitive process, temperature differences between different portions of web 120 can be reduced substantially. This means that web 120 can undergo further heating (e.g., in order to fully dry lighter inks) within the drying system while substantially reducing the risk of overheating dark regions.

Figure 5:
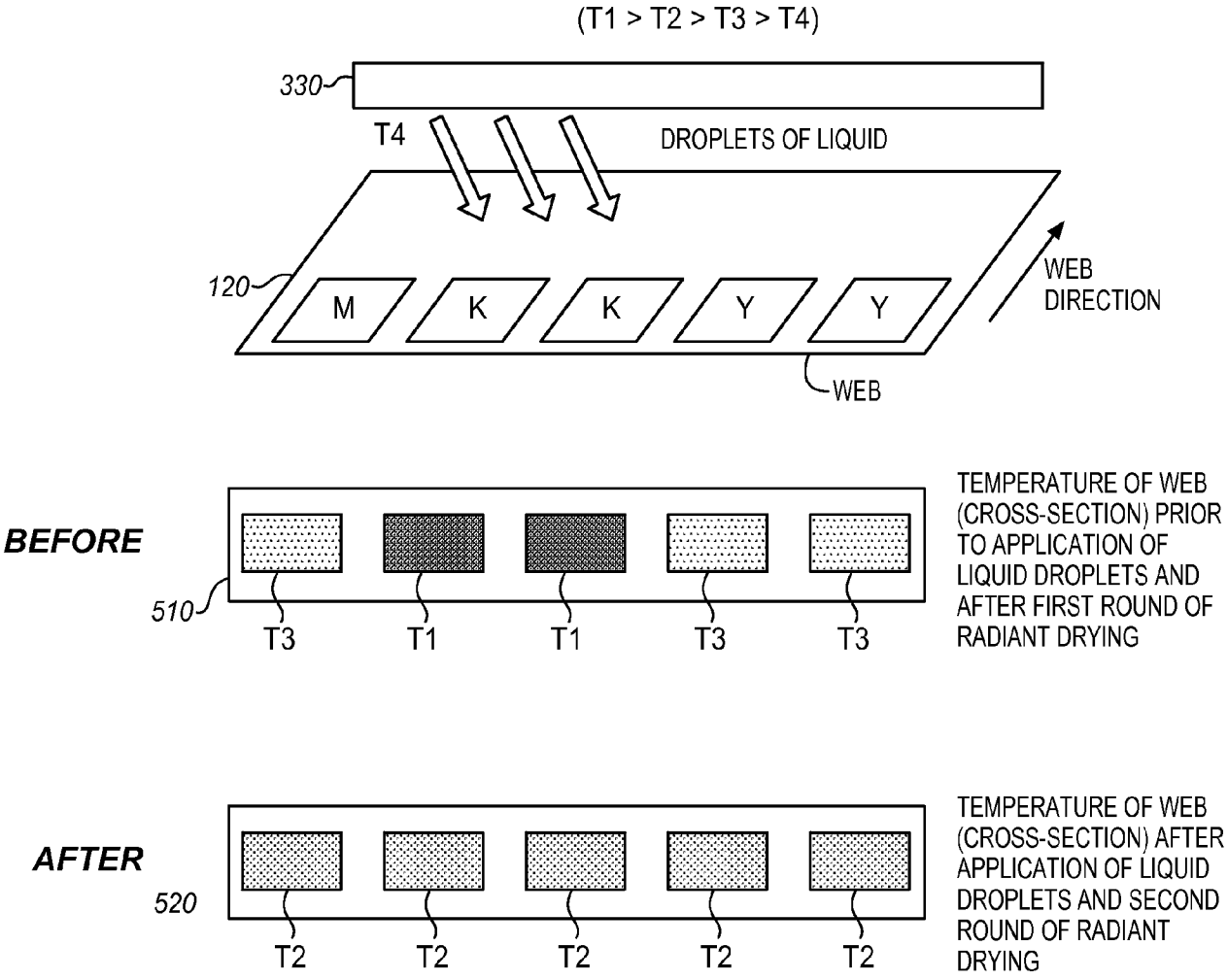
FIG. 5 is a diagram illustrating droplets of liquid striking a web of printed media in an exemplary embodiment.
Figure 6:
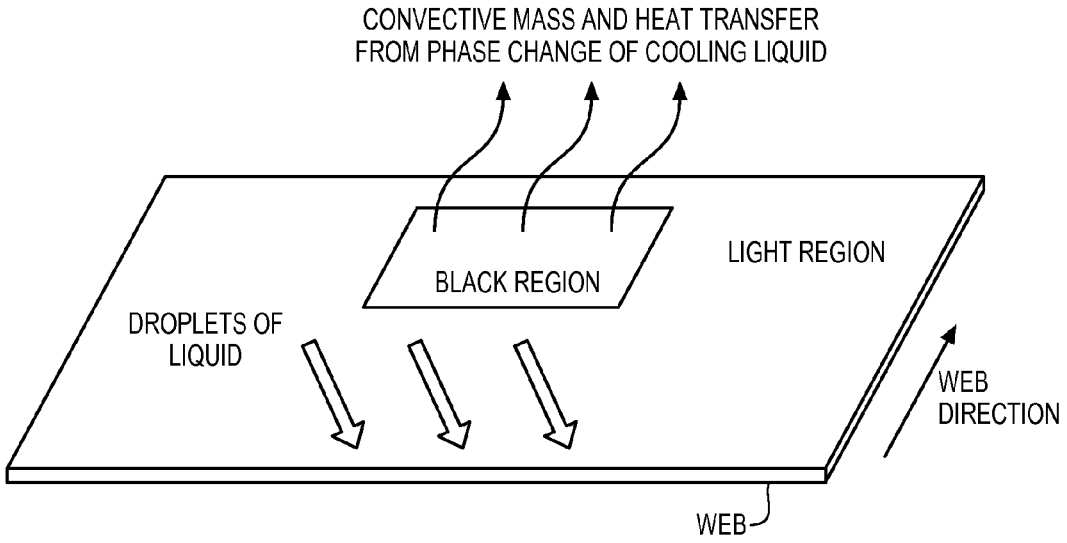
FIGS. 6-7 are diagrams illustrating convective heat transfer out of a web of printed media in an exemplary embodiment.
Figure 7:
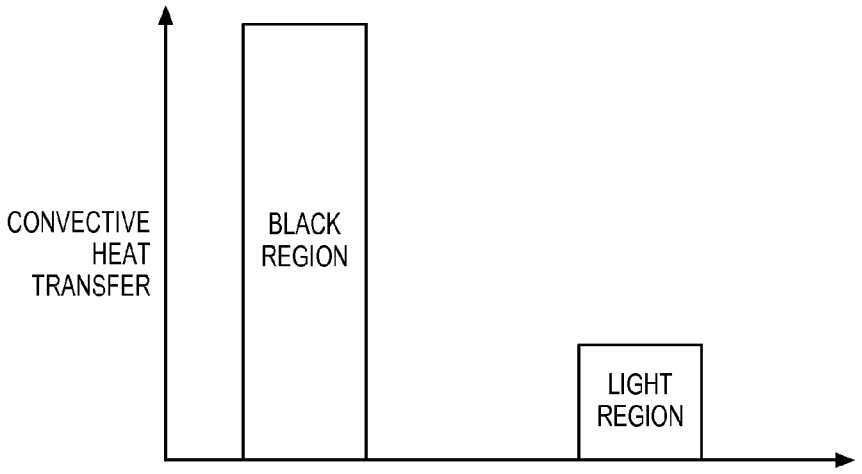

FIGS. 5-7 illustrate benefits of selectively applying droplets of liquid to hot, dark regions on web 120 during drying. Specifically, FIG. 5 is a diagram illustrating droplets of liquid striking dark regions of a web of printed media in an exemplary embodiment. According to FIG. 5, before the liquid is applied, cross-section 510 shows that portions of the web marked with black ink (K) reach a high temperature T1 (e.g., about 180° C.) while traveling through a dryer. The black ink has therefore fully dried onto the web and is about to overheat. In contrast, portions of the web marked with lighter inks (M, Y) have absorbed less radiant energy, and are at a lower temperature T3 (e.g., about 70° C.). These inks are not yet fully dry. Therefore, more time is needed in the dryer to complete the drying process for these inks. However, applying liquid to the lighter inks (which are still wet) can cause smearing in this embodiment. At the same time, further heating would normally be dangerous, because it would risk overheating the black portions of the web.

To solve both of these problems, FIG. 5 shows that liquid dispersal unit 330 applies droplets of liquid (e.g., water) at temperature T4 (e.g., about 25° C.) to the black portions of the web, but not to the lighter portions of the web. The web then continues to travel through the dryer to receive thermal energy. This means that the temperature of the lighter portions will increase to allow drying, while the black portions will not overheat. Cross-section 520 illustrates that after the liquid coolant has been applied and the web continues to travel underneath heating elements of the dryer, the temperature of the light portions and the black regions has substantially converged at T2 (e.g., about 160° C.). Balancing out the temperature differences along the web has the further benefit of reducing the chances of warping and distortion between regions.

FIG. 6 is a diagram illustrating convective heat transfer out of a web of printed media in an exemplary embodiment. According to FIG. 6, droplets of liquid are applied to a high-temperature black region of a web of print media. Regions of the web marked with lighter inks are not likely to scorch in this embodiment, and therefore have not received droplets of the liquid coolant. In this case, because the black region is more absorptive than the lighter region, it absorbs more energy from the dryer. However, heat transfer from the black region to the cooling liquid (which evaporates off of the web) balances out the higher heat absorption of the black region. Thus, the heat absorbed by the liquid as it undergoes the phase change is carried off by the liquid when it vaporizes and is dispersed into the dryer. The increased convective heat transfer for the black region is shown in FIG. 7.

Any suitable system may be used to apply liquid droplets onto a web of print media as discussed above. For example, FIG. 8 and the descriptions below illustrate multiple exemplary liquid dispersal units.

Figure 8:
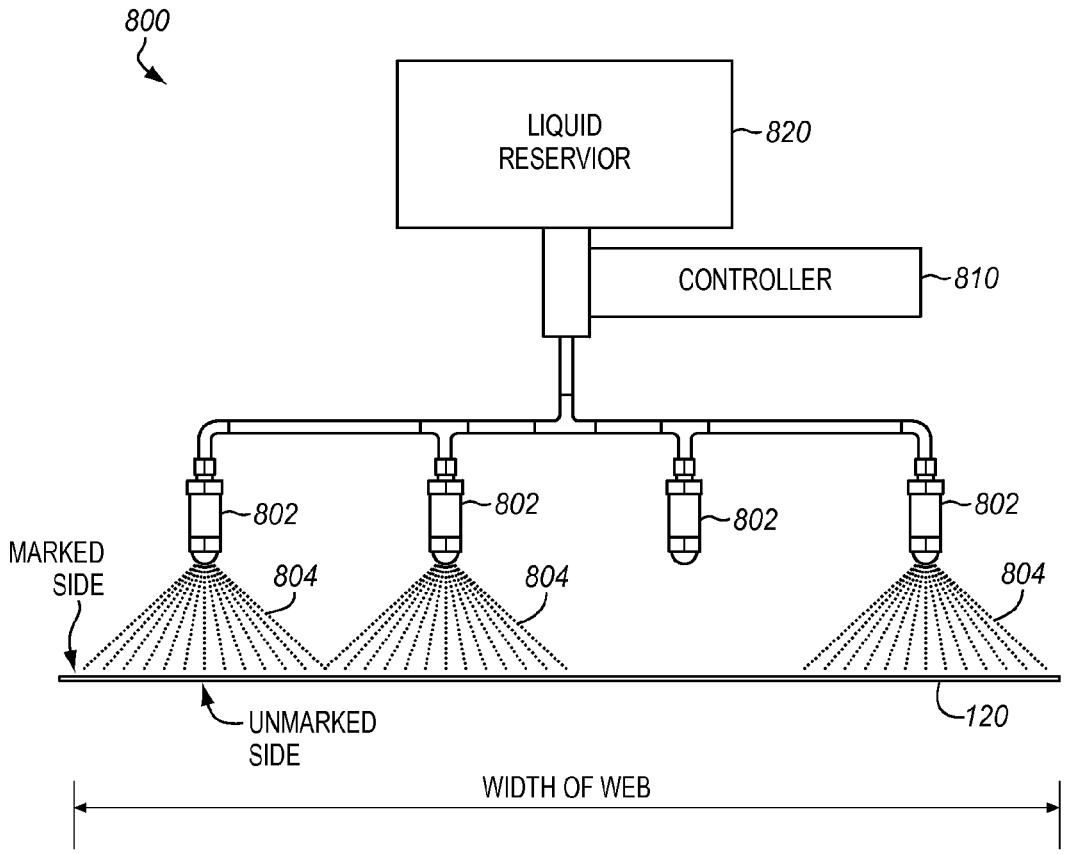
FIG. 8 illustrates a liquid dispersal unit in an exemplary embodiment.

FIG. 8 illustrates liquid dispersal unit 800 in an exemplary embodiment. In this embodiment, liquid dispersal unit 800 includes a plurality of spray nozzles 802 that are able to spray a mist 804 of liquid on the marked side of web 120. Nozzles 802 are spaced along the width of web 120 to evenly spray the mist 804 of liquid across the width of web 120. Liquid dispersal unit 800 further includes a controller 810 and a liquid reservoir 820. Controller 810 comprises any component that is able to control the application of the liquid by nozzles 802 on the marked side of web 120. Specifically, controller 810 can selectively actuate nozzles 802 (i.e., on/off), and is also able to control the flow rate of nozzles 802. For example, the nozzle placed in the middle-right of FIG. 8 is turned off, while the other nozzles are turned on. Reservoir 820 comprises any container that is able to store the liquid. While only four nozzles are shown in this embodiment, the number of nozzles may vary as a matter of design choice. For example, liquid dispersal units may utilize hundreds of nozzles along the width of web 120 in order to accurately place liquid droplets onto dark or high temperature regions of web 120.

In a further embodiment, the number and size of nozzles (or other fluid flow devices) varies based on the energy of heating elements within the dryer, the rates of drying for different ink colors, the speed at which the web travels through the dryer, the volume of liquid applied per liquid dispersal unit, the locations of heating elements within the dryer, and/or the distance between liquid dispersal units within the dryer. For example, a dryer that uses high energy heating elements may use a large number or size of nozzles.

In one embodiment, the liquid dispersal unit comprises an insulated printhead array that sprays water onto the web. The specific coolant applied may be chosen based upon the specific heat of the coolant, the temperature at which the coolant undergoes a phase change from liquid to gas, the amount of energy absorbed by the coolant during a phase change, and chemical compatibility with the ink and/or web (e.g., a coolant should not degrade the quality of the applied ink). For example, the coolant may comprise water, water with a surfactant applied (to lower surface tension and make droplet ejection easier), a humectant to aid drying such as a glycerin or a glycol, and other liquids.

In a further embodiment, a flow controller may prevent the application of liquid droplets to regions of the web if the regions are below a lower-bound threshold temperature. For example, ink at a low temperature such as about 70° C. may not be fully dried. Applying liquid to ink at such a low temperature may therefore cause the ink to smear.

In a further embodiment, multiple liquid dispersal units are placed within the drying system to apply droplets of liquid to the web multiple times as it travels through the dryer. This may be desirable when multiple inks are used that each have different drying characteristics. For example, one liquid dispersal unit may be placed within the dryer at a location where black ink is expected to dry, one liquid dispersal may be placed within the dryer at a location where cyan ink is expected to dry, etc.

In a still further embodiment, one or more arrays of temperature sensors are placed within the drying system along the width of the web. Then, a flow controller directs a liquid dispersal unit to apply liquid droplets to hot regions of the web. For example, the liquid dispersal unit may apply specified volumes of liquid to regions of web that are over a threshold temperature (e.g., about 160° C.-170° C.). Furthermore, the specific volume of liquid (e.g., number and/or size of droplets) applied may vary based on how much the temperature of a given region exceeds the threshold. A region may comprise a small (e.g., single pixel) portion of the web, or may comprise larger portions (e.g., groups of ten pixels, 4" by 4" sections, etc.).

In another embodiment, a flow controller may receive print data that describes the color and density of inks that have been applied to the web by an upstream printer. The flow controller then accesses the print data to determine an absorptivity of each region on the web, based on the inks applied to that region. Based on absorptivity, the flow controller then estimates a temperature that each region will reach inside of the drying system, and directs a liquid dispersal unit to apply droplets of liquid based on the estimated temperatures. A specific threshold temperature may even be defined for each color of ink and/or combination of ink colors.

EXAMPLES

In the following examples, additional processes, systems, and methods are described in the context of a drying system that applies droplets of liquid to a web of printed media in an exemplary embodiment.

Figure 9:
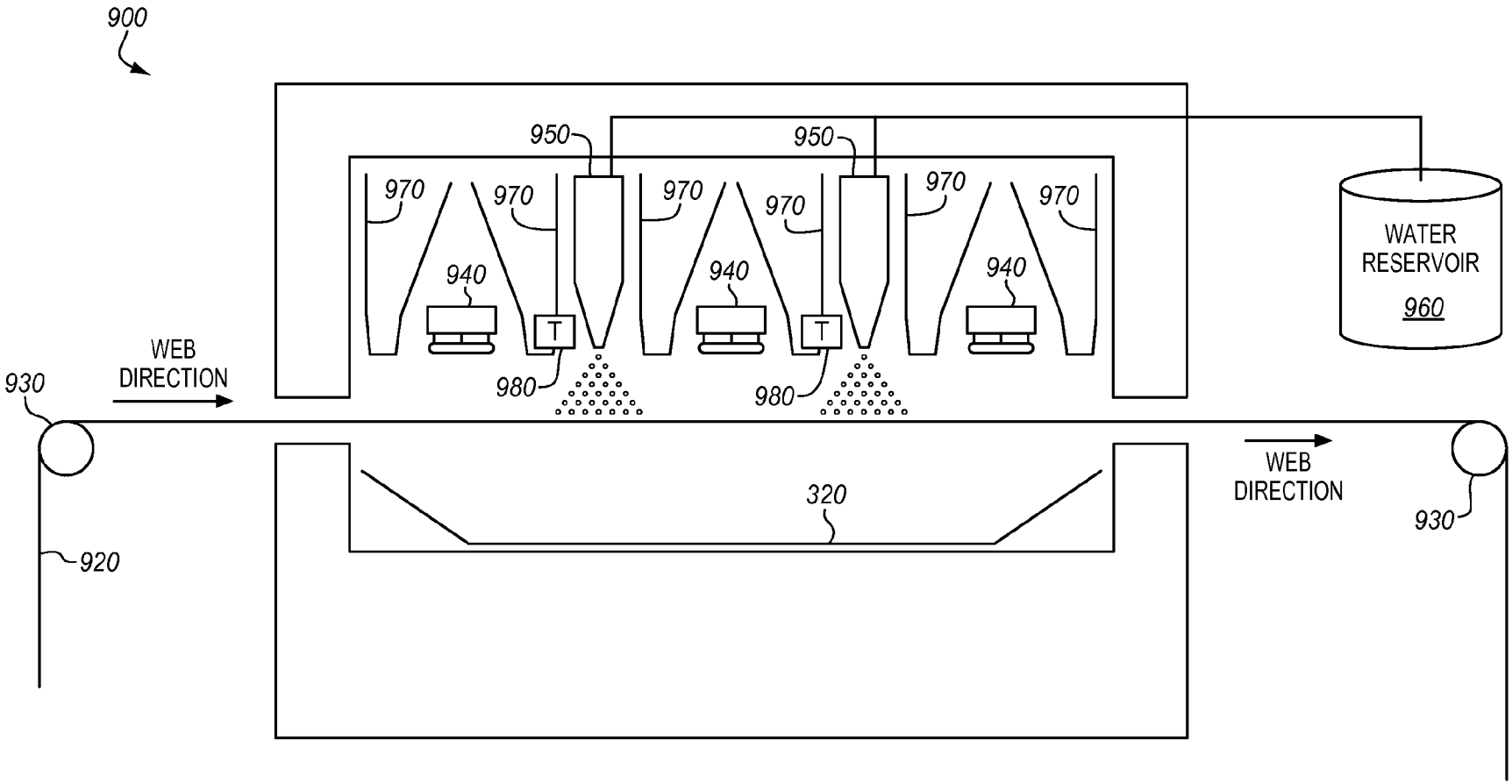
FIG. 9 is a diagram of an exemplary drying system.

FIG. 9 is a diagram of a further exemplary drying system in an exemplary embodiment. According to FIG. 9, web 920 comprises a web of paper that has been inked by an upstream continuous-forms inkjet printer and positioned by rollers 930. The ink on web 920 is still wet as it enters drying system 900.

As web 920 travels through drying system 900 at a linear velocity of up to ten feet per second, web 920 is alternately heated by radiant heat lamps 940 and cooled by droplets of ambient-temperature liquid water projected from insulated printhead arrays 950. The droplets of water range from two to one hundred picoliters in size. Printhead arrays 950 receive water from water reservoir 960, and printhead arrays 950 are protected from radiant heating by reflectors 970. Each printhead array 950 comprises three hundred printhead nozzles distributed along the width of web 920.

During this process, arrays of temperature sensors 980, which have been placed within drying system 900 along the width of web 920, are used to determine how hot different regions along the width of web 920 have become. Each array of temperature sensors 980 may comprise three hundred individual temperature sensors distributed along the width of web 920. In other embodiments, the array may comprise a greater or fewer number of individual sensors or may be a single sensor. When a temperature sensor determines that a region exceeds a temperature threshold (160° C.), it is known that the region has completed drying. However, the region will still travel underneath more heating elements, and may therefore increase in temperature and risk scorching. To prevent overheating, a printhead array 950 sprays droplets of liquid water onto that region. The volume dispersed by the printhead array 950 varies depending on the amount by which the region exceeds the temperature threshold, for example between about ten and twenty picoliters per nozzle.

Even though the temperature of web 920 tends to increase as it passes underneath each radiant heat lamp 940, the temperature differences between highly absorptive inked portions and less absorptive inked portions of web 920 remain fairly small. This is because the liquid droplets applied to the high temperature regions of web 920 absorb energy that would otherwise heat those regions. This ensures that no unexpected variations in temperature will cause overheating at web 920.

Figure 10:
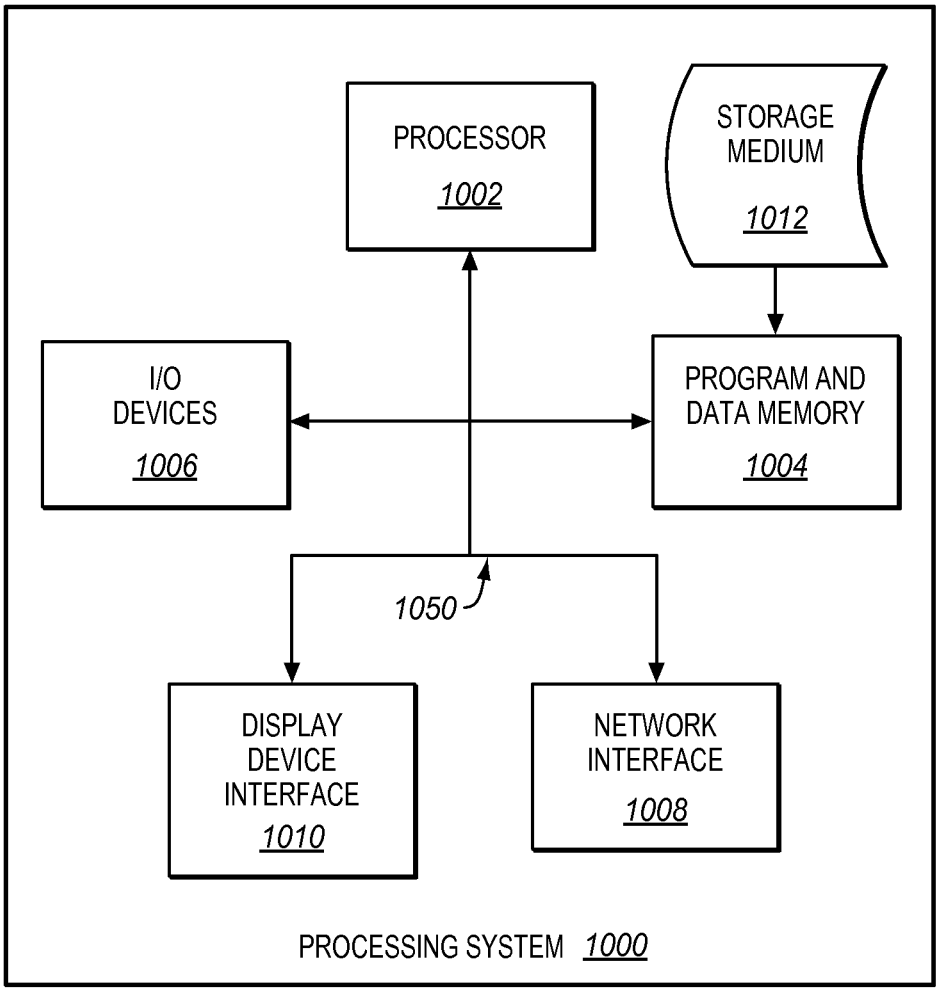
FIG. 10 illustrates a processing system operable to execute a computer readable medium embodying programmed instructions to perform desired functions in an exemplary embodiment.

In one particular embodiment, software is used to direct a processing system of flow controller 340 of FIG. 3 in order to dynamically regulate the amount of flow supplied to one or more liquid dispersal units (e.g., based on a determined speed of a web of print media). FIG. 10 illustrates a processing system 1000 operable to execute a computer readable medium embodying programmed instructions to perform desired functions in an exemplary embodiment. Processing system 1000 is operable to perform the above operations by executing programmed instructions tangibly embodied on computer readable storage medium 1012. In this regard, embodiments of the invention can take the form of a computer program accessible via computer-readable medium 1012 providing program code for use by a computer or any other instruction execution system. For the purposes of this description, computer readable storage medium 1012 can be anything that can contain or store the program for use by the computer.

Computer readable storage medium 1012 can be an electronic, magnetic, optical, electromagnetic, infrared, or semiconductor device. Examples of computer readable storage medium 1012 include a solid state memory, a magnetic tape, a removable computer diskette, a random access memory (RAM), a read-only memory (ROM), a rigid magnetic disk, and an optical disk. Current examples of optical disks include compact disk-read only memory (CD-ROM), compact disk-read/write (CD-R/W), and DVD.

Processing system 1000, being suitable for storing and/or executing the program code, includes at least one processor 1002 coupled to program and data memory 1004 through a system bus 1050. Program and data memory 1004 can include local memory employed during actual execution of the program code, bulk storage, and cache memories that provide temporary storage of at least some program code and/or data in order to reduce the number of times the code and/or data are retrieved from bulk storage during execution.

Input/output or I/O devices 1006 (including but not limited to keyboards, displays, pointing devices, etc.) can be coupled either directly or through intervening I/O controllers. Network adapter interfaces 1008 may also be integrated with the system to enable processing system 1000 to become coupled to other data processing systems or storage devices through intervening private or public networks. Modems, cable modems, IBM Channel attachments, SCSI, Fibre Channel, and Ethernet cards are just a few of the currently available types of network or host interface adapters. Presentation device interface 1010 may be integrated with the system to interface to one or more presentation devices, such as printing systems and displays for presentation of presentation data generated by processor 1002.

Although specific embodiments were described herein, the scope of the invention is not limited to those specific embodiments. The scope of the invention is defined by the following claims and any equivalents thereof.

We claim:

1. An apparatus comprising:

a dryer of a printing system comprising:

a heating element within an interior of the dryer that is operable to heat a web of printed media as the web travels through the interior;

a liquid dispersal unit within the interior that is operable to project liquid droplets of coolant onto the web as the web travels through the interior in order to control the temperature of the web; and a controller operable to select a flow rate of the liquid droplets for each of multiple regions on the web by identifying a colorant applied to a region of the web and selecting the flow rate for the region based on heat absorption characteristics of the colorant.

2. The apparatus of claim 1, further comprising:

at least one temperature sensor within the interior of the dryer that is operable to measure the temperature of a region of the web;

wherein the controller is further operable to select the flow rate for the region based on a measured temperature of the region.

3. The apparatus of claim 1, wherein:

the liquid dispersal unit is operable to directly apply the liquid droplets of the coolant to a marked side of the web.

4. The apparatus of claim 1, wherein:

the coolant includes a liquid humectant.

5. The apparatus of claim 1, wherein:

the coolant includes water treated with a surfactant.

6. The apparatus of claim 1, wherein:

the liquid dispersal unit includes at least one spray nozzle operable to spray the liquid droplets of coolant onto the web.

7. The apparatus of claim 6, wherein:

the liquid dispersal unit includes a printhead array comprising multiple printhead nozzles distributed along the width of the web, each printhead nozzle operable to disperse one or more liquid droplets of the coolant onto the web.

8. The apparatus of claim 1, further comprising:

multiple liquid dispersal units, each liquid dispersal unit placed within the interior of the dryer at different locations along a direction of travel of the web.

9. A method comprising:

operating a heating element within an interior of a dryer to heat a web of printed media as the web travels through the interior;

projecting, via a liquid dispersal unit within the interior of the dryer, liquid droplets of coolant onto the web as the web travels through the interior of the dryer in order to control the temperature of the web; and selecting a flow rate of the liquid droplets for each of multiple regions on the web, comprising:

identifying a colorant applied to a region of the web; and selecting the flow rate for the region based on heat absorption characteristics of the colorant.

10. The method of claim 9, further comprising:

measuring, with at least one temperature sensor within the interior of the dryer, the temperature of a region of the web; and selecting the flow rate for the region based on a measured temperature of the region.

11. The method of claim 9, further comprising:

directly applying the liquid droplets of the coolant to a marked side of the web.

12. The method of claim 9, wherein:

the coolant includes a liquid humectant.

13. The method of claim 9, wherein:

the coolant includes water treated with a surfactant.

14. The method of claim 9, wherein:

projecting liquid droplets comprises operating at least one spray nozzle to project the liquid droplets.

15. The method of claim 14, wherein:

projecting liquid droplets further comprises operating a printhead array comprising multiple printhead nozzles distributed along the width of the web to project the coolant.

16. The method of claim 9, further comprising:

projecting liquid droplets of coolant onto the web at different locations along a direction of travel of the web.

17. A non-transitory computer readable medium embodying programmed instructions which, when executed by a processor, are operable for performing a method comprising:

operating a heating element within an interior of a dryer to heat a web of printed media as the web travels through the interior;

projecting, via a liquid dispersal unit within the interior of the dryer, liquid droplets of coolant onto the web as the web travels through the interior of the dryer in order to control the temperature of the web; and selecting a flow rate of the liquid droplets for each of multiple regions on the web, comprising:

identifying a colorant applied to a region of the web; and selecting the flow rate for the region based on heat absorption characteristics of the colorant.

18. The medium of claim 17, wherein the method further comprises:

measuring, with at least one temperature sensor within the interior of the dryer, the temperature of a region of the web; and selecting the flow rate for the region based on a measured temperature of the region.

19. The medium of claim 17, wherein the method further comprises:

directly applying the liquid droplets of the coolant to a marked side of the web.

20. The medium of claim 17, wherein:

projecting liquid droplets further comprises operating a printhead array comprising multiple printhead nozzles distributed along the width of the web to project the coolant.

* * * * *